US007073777B2

(12) United States Patent
Branstetter

(10) Patent No.: US 7,073,777 B2
(45) Date of Patent: Jul. 11, 2006

(54) PORTABLE MODULAR WHEEL LIFT

(75) Inventor: D. Roger Branstetter, Farragut, TN (US)

(73) Assignee: Ann Branstetter, Knoxville, TN (US)

( * ) Notice: Subject to any disclaimer, the term of this patent is extended or adjusted under 35 U.S.C. 154(b) by 0 days.

(21) Appl. No.: 10/930,368

(22) Filed: Aug. 31, 2004

(65) Prior Publication Data

US 2006/0043350 A1 Mar. 2, 2006

(51) Int. Cl.
*E02C 3/00* (2006.01)

(52) U.S. Cl. ..... 254/88; 254/1

(58) Field of Classification Search ..... 254/88, 254/1; 14/69.5; 188/32; 248/352
See application file for complete search history.

(56) References Cited

U.S. PATENT DOCUMENTS 3,752,441 A 8/1973 Rogers
4,427,179 A 1/1984 Price
4,920,596 A 5/1990 Stevens
6,439,543 B1 * 8/2002 Peckham ..... 254/88
6,517,051 B1 * 2/2003 Cavanaugh ..... 254/88
6,539,572 B1 * 4/2003 Ware ..... 14/69.5
6,910,675 B1 * 6/2005 Cox ..... 254/1

* cited by examiner

*Primary Examiner*—Lee D. Wilson
(74) *Attorney, Agent, or Firm*—Pitts & Brittian, P.C.

(57) ABSTRACT

A modular wheel lift provides elevation of a vehicle wheel enclosed by body portions of a low height above the ground. A base lift unit includes a lift surface height selected to be less than the body portions height. A ramp unit is aligned and hingedly attached to one end of the base lift unit, to allow rotational movement of a wheel to the base lift surface. Additional lift units having ramp ends and progressively decreasing lengths are laterally positioned and stacked on the base lift surface. Side brackets are releasably positioned along either side surface to secure the stacked additional lift units to allow rotational movement of the vehicle wheel to an uppermost lift surface. A method of assembly and elevating includes laterally positioning and stacking a plurality of lift units having progressively shorter lengths to provide lifting of a vehicle wheel without disruption of the vehicle body portions.

11 Claims, 7 Drawing Sheets

PORTABLE MODULAR WHEEL LIFT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to portable devices for lifting a vehicle wheel. More particularly, this invention pertains to portable devices for lifting wheels of lowered vehicles.

2. Description of the Related Art

Portable ramp devices utilized for lifting one or more vehicle wheels off of a ground surface are available to facilitate changing a tire, for adjusting the vehicle suspension system, and to allow maintenance activities or inspection activities underneath the vehicle. Prior art portable ramp devices generally require at least about seven to eight inches clearance between the ground and the vehicle side frame, front bumper or rear bumper, depending on the preferred positioning for the ramp device. Due to the height above the ground of prior portable ramp devices, each ramp device is difficult to use for lifting modified vehicles having ground clearance heights reduced to between about three inches to about six inches due to suspension modifications and/or addition of front and rear bumper assemblies extending low to the ground surface, as is typical of modified "low aspect" or "street rod" vehicles. Typically for lowered cars or trucks having side aerodynamic fenders attached, one short two inch high jack device is initially used to initially lift the underside of the lowered car or truck, such as a scissor-extending jack, and a second jack having a six inch to eight inch height is utilized for further vehicle lift.

A prior art wheel ramp device is disclosed in U.S. Pat. No. 4,920,596, issued May 1, 1990, and includes a two level ramp device composed of a first ramp segment attachable at a rear portion to a second ramp segment providing a first support level, which is attachable at a rear portion to a third ramp having a second support level for positioning a car wheel thereon. The ramps have side legs connected by side rails, and each ramp is attachable end-to-end with pairs of end brackets extended backwards to cradle the trailing ramp between the end brackets. The design of the first and second ramps requires alignment end-to-end and assembly of the units by positioning each axially before connection to the respective pairs of end brackets. If a car wheel is driven onto the first ramp without the second and third ramps portion attached, the first ramp can "kick-out" or slide away from the wheel due to the limited bottom surface area provided by the side legs contacting against the ground surface. Use of this type of ramp device requires assembly before a car wheel progresses to an elevated height to allow aligning of each rear portion of second and third ramps when unweighted to protect the user from "kick-out" by the ramp device. Further, this type of ramp device requires end-to-end alignment for proper cradling by the end brackets extended from each rear portion of each ramp segment, thereby posing an unsafe situation if the operator attempted to assemble the aligned ramp segments while a front or rear wheel is on a first ramp segment and is partially elevated above a ground surface.

A leveling ramp device for a vehicle tire is disclosed in U.S. Pat. No. 4,427,179, issued Jan. 24, 2984, and includes a plurality of planar planks that are stacked with front ends forming a stairway for a wheel to climb, and having rear ends enclosed by a back frame having side members enclosing side wall portions of each stacked plank. Each ramp plank is further held in place by a downwardly projecting dowel which is inserted in the top surface of the next lower ramp plank to maintain alignment of the front portions of the stacked ramp planks. The plurality of ramp planks must be aligned, stacked and enclosed by the back frame before a vehicle tire is moved up the front end surfaces, otherwise the planks will be pushed sideways or backwards without the back frame and interlocking dowels in place. A vehicle tire can not be positioned in a partially elevated horizontal position other than on an uppermost surface, and additional ramp planks must be added before the tire is initially positioned at the uppermost height.

An elevating and leveling ramp device for a vehicle wheel is disclosed in U.S. Pat. No. 3,752,441, and includes a plurality of hollow blocks forming step-like sections that are nestable within the next larger hollow block. The elevating and leveling ramp device allows for extension of each hollow block from the next larger block to form a series of steps on which a vehicle wheel is moved. During accordion-like extension of respective hollow blocks from the next larger hollow block, the respective blocks are aligned and connected end-to-end, but are not laterally movable for disassembly while the vehicle wheel is positioned on any of the blocks. Therefore, any larger hollow blocks must be added to the ramp device before a vehicle wheel is moved on a low height block or on a middle height block.

There exists a need for a portable modular wheel lift which provides a laterally assembled combination of modular units for incrementally lifting a wheel of a vehicle having minimal ground clearance. There is a further need for a method for assembly and operation of a modular wheel lift system for elevating one or more wheels of a vehicle having minimal ground clearance.

BRIEF SUMMARY OF THE INVENTION

According to one embodiment of the present invention, a portable modular wheel lift is provided for elevating of one or more front and/or rear wheels of a vehicle having end or side body portions extended proximal to the ground. The portable modular wheel lift includes a base lift unit having a base length greater than a base width, and a base support surface disposed at a first lift height selected to be less than the ground clearance height of the vehicle body portions.

A primary ramp unit is aligned with a forward portion of the base lift unit, and includes a non-sloped rearward end hingedly attached to the forward portion of the base lift unit. A first ramp surface is opposed from the on-sloped end and is angled for gradual traversal by a vehicle wheel. The primary ramp unit includes a first support surface extended horizontally and rearwardly from the first ramp surface. The ramp unit first support surface is about equal in height with the base surface height to provide a first lift position for a wheel of a vehicle having lowered body portions without disrupting the body portions.

A second lift unit is positionable on the base support surface of the base lift unit. The second lift unit includes a second length less than the base length of the first lift unit and includes a second width comparable to the base width. The second lift unit is laterally positioned to align and stack on the rearward portion of the base support surface, and further includes a second ramp surface angled for traversal by a wheel from the base support surface to a second support surface of the second lift unit. Without disruption of the vehicle body portion, the vehicle wheel is readily moved up the second ramp surface to the second lift position. If an additional lift height is needed to allow maintenance under the vehicle body, a third lift unit is readily stackable on the second support surface while a vehicle wheel is retained on the second lift unit. A third lift unit having a length less than the length of the second lift unit is positionable on a rearward portion of the second lift unit. The third lift unit includes a ramp surface angled to allow traversal of the wheel to a third lift position above the ground.

A plurality of side brackets are utilized to releasable secure the second lift unit on the base support surface, and to releasably secure the third lift unit, if utilized, on the second support surface. Each side bracket includes an elongated configuration having upper and lower connectors which are releasably inserted into any one of a plurality of holes in the respective right and left side surfaces of the second lift unit, third lift unit, and the base lift unit thereby temporarily securing each stacked lift unit on the next lower lift unit support surface. A pivotable back bracket is utilized to stop a vehicle wheel from rolling off a rearward end of the uppermost lift unit. The back bracket includes a stop plate having a flanged upper segment that is preferably maintained in a vertical orientation against the rearward ends of the stacked lift units. The pivotable back bracket allows the flanged upper segment to be pivoted to a lowered position for detachment of the back bracket and disassembly of the uppermost lift unit from the rearward ends of the stacked lift units.

A method of assembly and operation is provided for elevating one or more wheels of a vehicle having body portions extended to a height proximal to the ground. A step of providing includes providing a base lift unit and a primary ramp unit having a first lift height which is less that the height of the vehicle body portions above the ground. A step of joining includes aligning a non-sloped end of the primary ramp unit with a forward portion of the base lift unit and joining the aligned units by means for pivoting, whereby the base lift unit has a first lift height for a vehicle wheel and the primary ramp unit is adjustable in angle relative to the base lift unit allowing operation of the steps for elevating on uneven ground surfaces. A step of aligning provides the base lift unit and joined primary ramp unit in alignment in front or behind one or more front and/or rear wheels. A step of moving provides for vehicle wheels rotation to traverse the primary ramp unit for elevating one or more wheels to the first lift height on the base lift unit.

The method of operation further includes a step of stacking of additional lift units on the base lift unit by a lateral access to the base lift unit support surface, with each of the additional lift units having progressively lesser lengths, having substantially equal widths, and having substantially equal incremental lift heights whereby an uppermost lift height is provided upon completion of the step of stacking. A step of securing provides a plurality of side brackets releasably secured between side surfaces of the base lift unit and each additional lift unit stacked thereon. Upon completion of the step of securing, a step of sequentially moving the vehicle wheels provides for traversal of one wheel on an upper support surface for each stacked lift unit used to elevate one or more wheels to an uppermost lift height without disruption of the vehicle body portions.

The method for elevating further includes a step of attaching an extension lift member to a rearward position aligned with the non-sloped ends of the stacked lift units, with the extension lift member providing an additional lift height up to about a foot above the ground surface. The method for elevating further includes positioning a pivotable stop member against a rear end surface of either the extension lift member or the non-sloped ends of the stacked lift units, with the pivotable stop member being manipulated to a vertical position to extend above the rear end of the uppermost lift height to retain a vehicle wheel from rolling off of the uppermost support surface. When one or more vehicle wheels are elevated on respective modular wheel lifts, maintenance activities are accomplished under the vehicle body without damaging the vehicle body portions.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
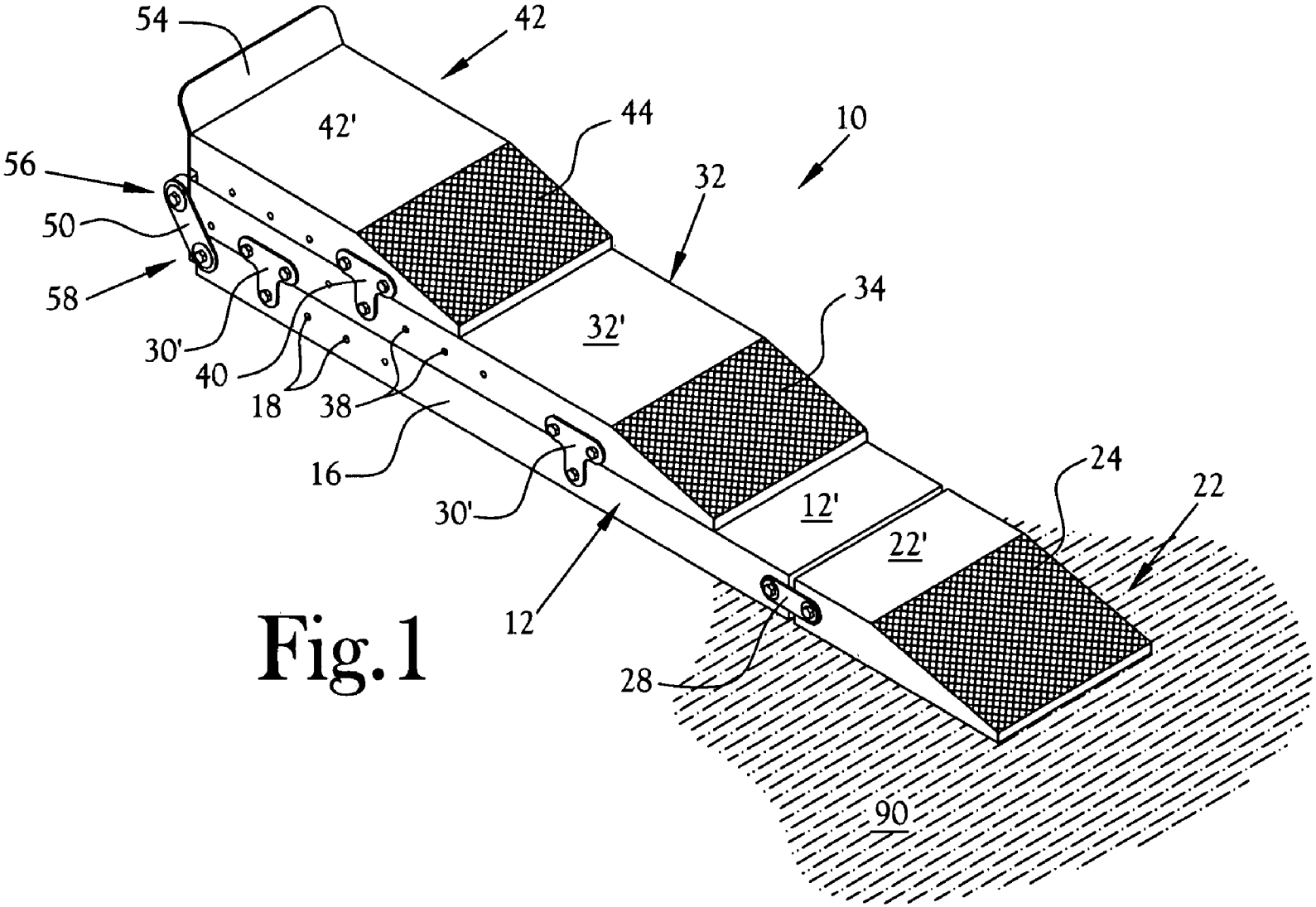
FIG. 1 is a perspective view of a modular wheel lift of the present invention including multiple lift units.

A portable modular wheel lift unit having a plurality of lift units is disclosed for lifting to a variety of heights for one or more wheels 80, 82 of a vehicle front and/or rear 84, 86 having front, side and/or rear body portions extended to a low height above a ground surface 90. The wheel lift is illustrated at 10 in FIGS. 1–9, and includes a plurality of modular segments which are positionable from a right or left lateral approach onto a base lift unit 12 in order to provide a variety of lift heights for lifting one or more wheels 80, 82 of a vehicle. A method of operation is also disclosed for lifting at least one vehicle wheel 80, 82 utilizing a portable modular wheel lift 10 which is sequentially assembled by lateral positioning the stackable components from either a right or left side of the base lift unit 12, regardless of whether a vehicle wheel 80, 82 is positioned on a ramp surface or a horizontal support surface of the base lift unit 12.

The base lift unit 12 is configured in an elongated shape having a rectangular cross-section with a planar ground contacting surface having a plurality of width base members to provide a stable base having a significant surface area for distribution of a vehicle's weight against the ground surface 90. A base length 12''' is preferably greater than a base width 12", with the width being between about ten inches to about fourteen inches in order to support wide vehicle wheels on which is mounted a tire width of between about ten inches to about thirteen inches in width. A base support surface 12' is substantially planar and horizontal for support of a wheel thereon in a first lift position 72. The base support surface 12' includes a forward end 14 and a rearward end 14' which provide a boundary for the base support surface 12' having a base length 12''' of between about twenty-five inches to about forty-eight inches in length. The base surface height 72 is preferably less than the ground clearance height of the low height of the vehicle body portions to avoid contact between the vehicle body portions and the base lift unit 12. A base surface height 16" of about three inches to about four inches above the ground surface 90 is preferred to allow initial positioning of the primary ramp unit 22 under a lowered front end 84, side portion, and/or rear end 86 of a vehicle having body portions with a minimal ground clearance height. The base lift unit right side 16 and left side 16' are oriented generally vertical, but can be curved inwardly or outwardly to provide an actuate grip surface to facilitate gripping of the sides during assembly and disassembly of the base lift unit 12 with other similar but lesser sized lift units 32, 42. The interior of base lift unit 12 can be solid or, in order to reduce weight, can include interior cavities 88 (see FIG. 9) separated by internal walls extended to end flush with the ground contacting base of the lift unit 12. An alternative embodiment of a two part base lift unit 12"" includes two base sections 12', 12"" of similar cross-section, lift surface height, and width (see FIG. 7), but each base section is about half the length of the base lift unit 12 illustrated in FIG. 1. During use, the two base sections are readily aligned to form base lift unit surfaces 12', 12"" (see FIG. 7), and are attached by one or more brackets 28, 28' spanning a gap between the base sections, before the stacking of additional lift units of progressively shorter lengths 32, 42 thereon.

A front ramp, also identified as a primary ramp unit 22, is aligned with the base lift unit forward end 14 and includes a first ramp surface 24 and a non-sloped rearward end 26" which is maintained a spaced apart distance of about an inch from the base lift unit forward end 14 due to separation being maintained by a pivotable bracket 28 connected to a lower portion of the base lift unit forward end 14. The first ramp surface 24 is angled 24' (see FIG. 2) between about ten degrees to about forty-five degrees, with a preferred angle of about twelve degrees to about twenty degrees from the horizontal plane of the ground surface 90, to provide a gradual ascent or descent by either front or rear vehicle wheels 80, 82. A first support surface 22' is substantially flat and includes a base width approximately the same as base width 12" of between about ten inches to about fourteen inches. The first support surface 22' includes a flat upper surface length of between about six inches to about twelve inches in length. The primary ramp unit 22 includes left and right side walls 26, 26' having at least one hole 28''' in each side wall for attachment of two pivotable brackets 28, 28' by connectors 28". An end-to-end length 22''' of primary ramp unit 22 is between about twelve inches to about twenty-four inches.

A first step of elevating a vehicle having front, side and/or rear body portions extended to a low height includes either a front wheel 80 or a rear wheel 82 being moved up the first ramp surface 24 to rest on the first support surface 22' and the base support surface 12'. The base width of the base lift unit 12 and first ramp unit 22 at a first lift position 72 having a height of between about three inches to about four inches above the ground surface 90 (see FIG. 5). The pivotable bracket 28 is illustrated in FIGS. 1, 2, 5 and 6, and includes right and left elongated side brackets 28, 28' positioned to extend across a gap between a lower corner of the base lift unit forward end 14 and a lower corner of the ramp unit rear end 26". The opposed ends of each side bracket 28, 28' are pivotably attached by connectors 28" to allow the ramp unit 22 to be readily adjusted in height of between about one to two inches relative to the base lift unit 12 to accommodate uneven ground surfaces. The bottom surfaces of the ramp unit 22 and the base lift unit 12 may be covered with non-skid pads (not shown), or may have attached thereon a plurality of anti-skid protrusions 14" (see FIG. 5).

A second lift unit 32 is laterally positionable to align and stack on a rearward portion of the base support surface 12' of the base lift unit 12. The second lift unit 32 includes a second length 32''' of between about twenty-eight inches to about forty-four inches, a second width comparable to the base width 12" of between about ten inches to about forty-five degrees, and a ramp surface 34 with a preferred angle of about twelve degrees to about twenty degrees from the horizontal plane of the ground surface 90. The second lift unit 32 includes a lift height 72 of between about three inches to about four inches in height, and is laterally positioned by manipulating the unit over the left side 16 or over the right side 16' of the base lift unit 12 to stack on the rearward portion of the base support surface 12' regardless of whether a vehicle wheel is positioned on the first support surface 22', or the wheel is rotated to be positioned on a first planar portion of the base support surface 12'. The second lift unit 32 includes a second ramp surface 34 angled between about ten degrees to about forty-five degrees, with a preferred angle between about twelve degrees to about twenty degrees for gradual traversal of the vehicle wheel from the base support surface 12' to a second support surface 32'. The depth of the second lift unit 32 is between about three inches to about four inches, therefore the height of the second support surface 32' is between about six inches to about eight inches above the ground surface 90. During use for lifting a front wheel 80 or a rear wheel 82, the second lift unit 32 is laterally positioned on and secured to the base support surface 12' utilizing readily manipulated and releasable brackets 30 connected to either the left sides 16, 36 or right sides 16', 36' of the stacked units 12, 32. The second lift unit 32 is readily removed by disconnection of the brackets 30, lateral displacement off of the base support surface 12', and replacement with an alterative lift unit having a greater height (not shown), to obtain a greater lift for either front wheel 80 or rear wheel 82 moved from the base support surface 12' to a second lift position 74 (see FIG. 6) without disruption of vehicle body portions.

Figure 2:
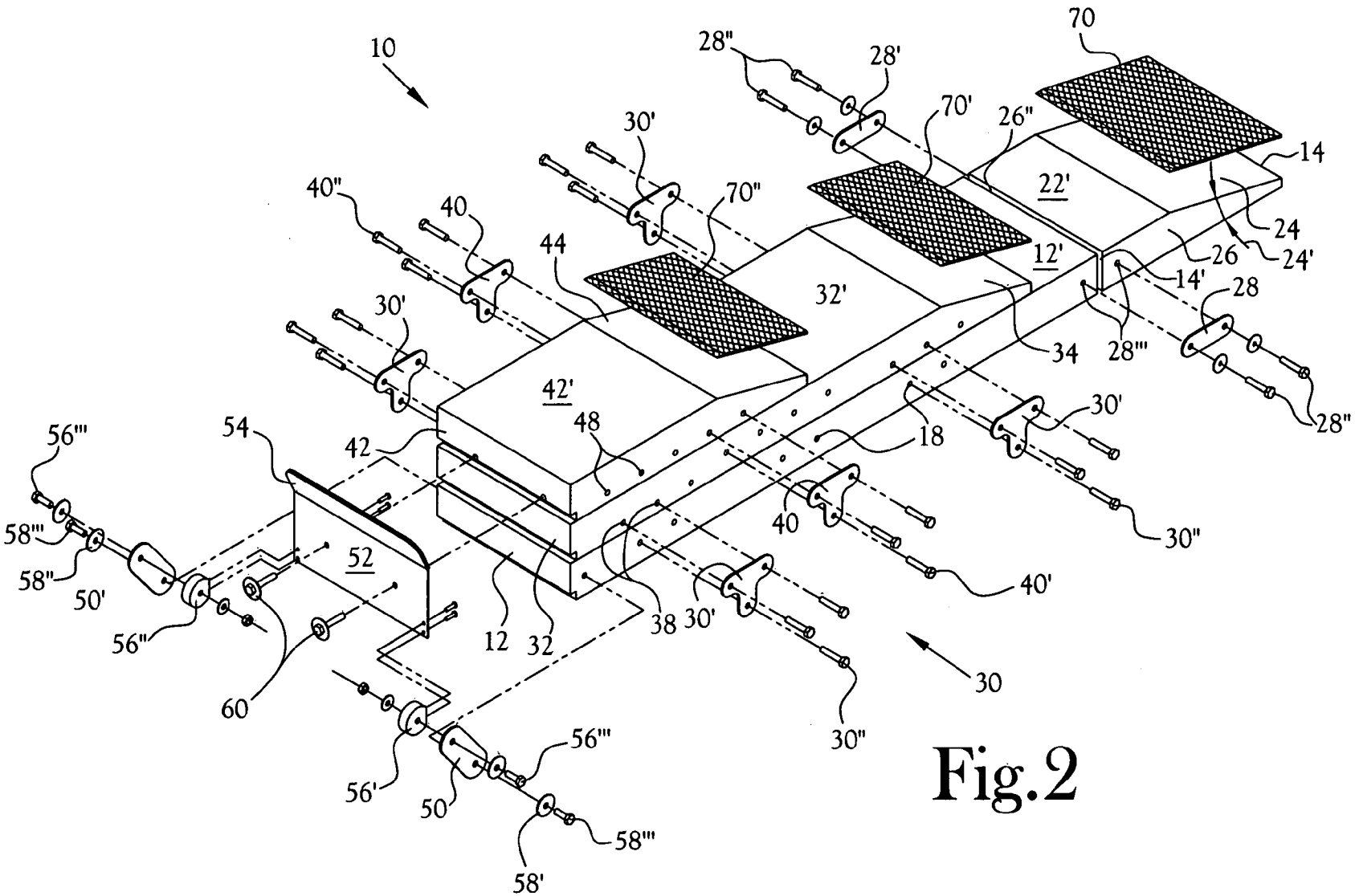
FIG. 2 is a rear exploded view of the wheel lift of FIG. 1.
Figure 7:
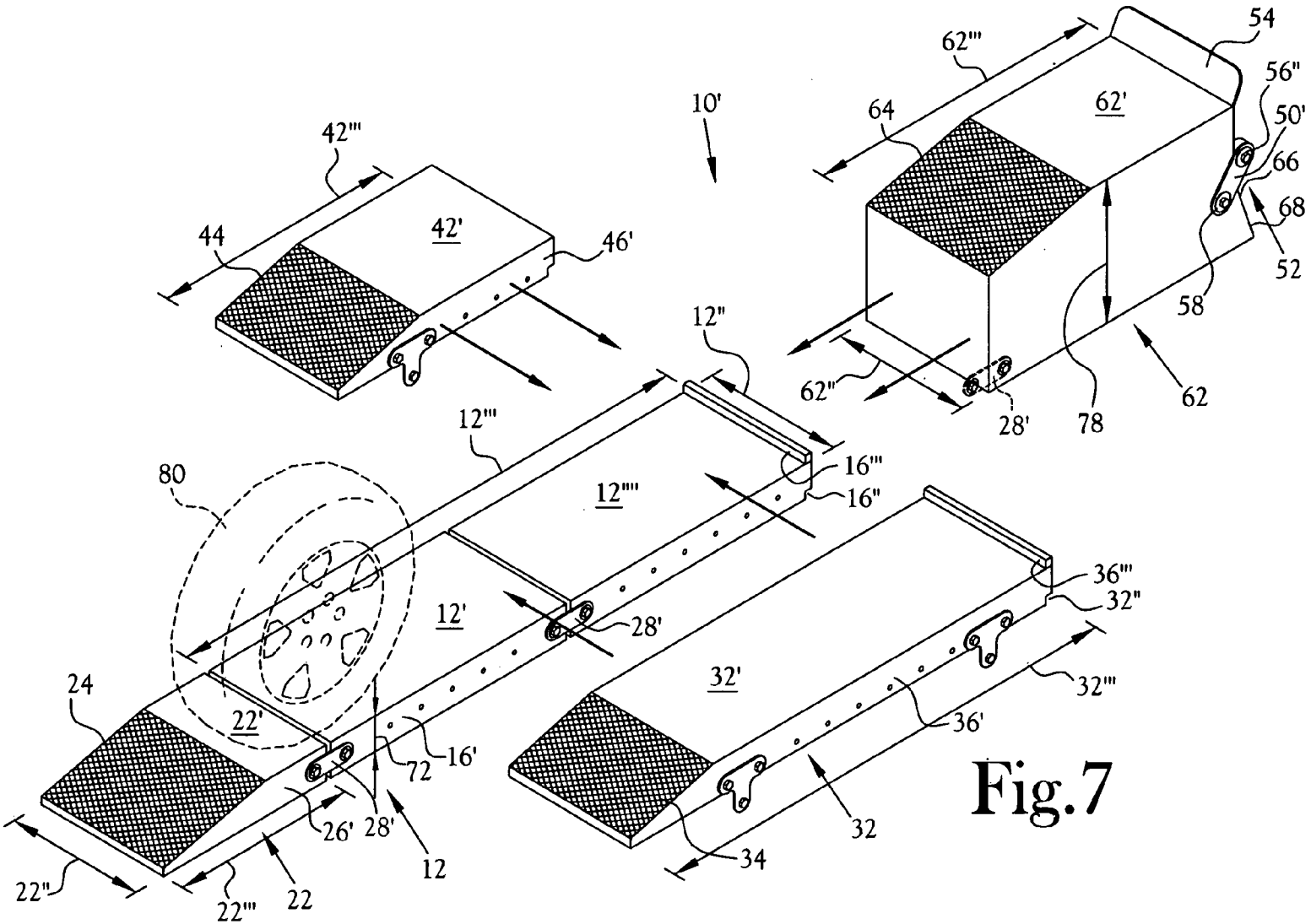
FIG. 7 is a perspective view of a method of assembly for the modular wheel lift illustrating second and third lift units laterally positionable on the base support surface and having a fourth lift unit aligned with the second and third lift units.
Figure 8A:
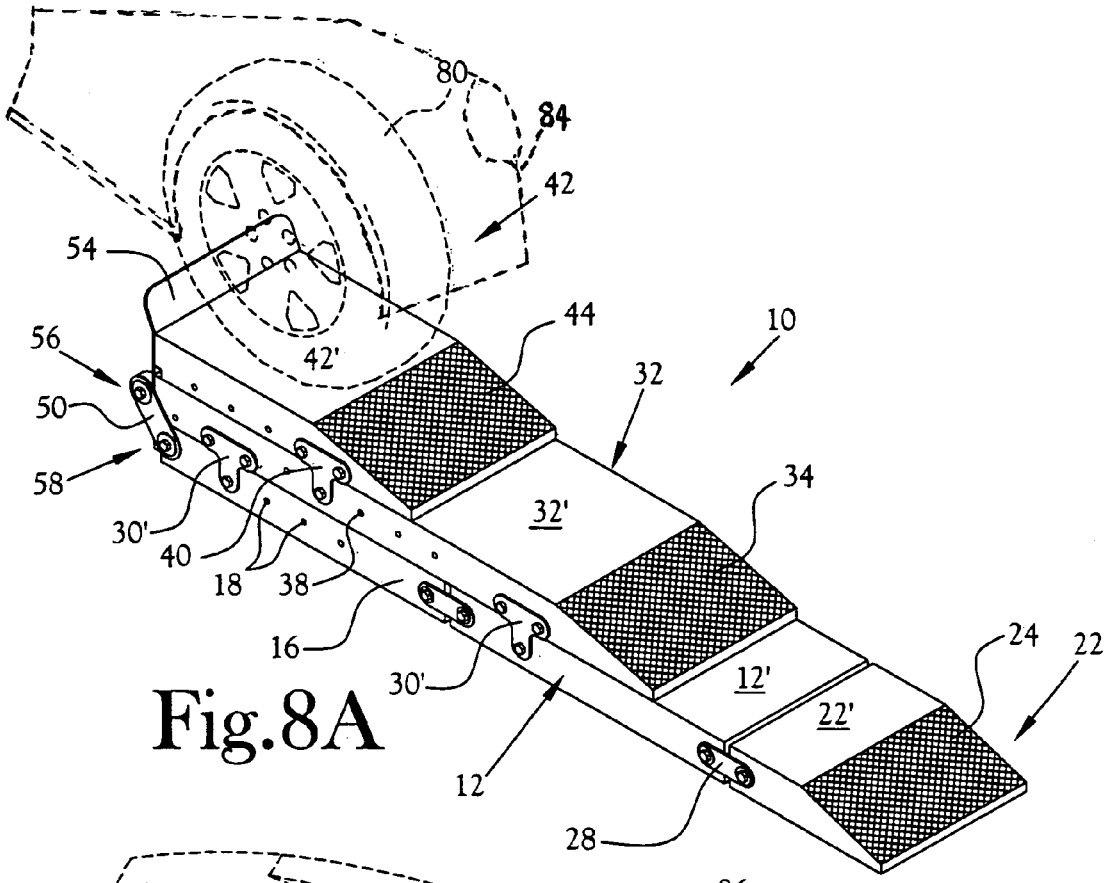
FIG. 8A is a perspective view of a wheel lift having a front wheel rotated to a third support surface after assembly of the wheel lift behind the front wheel.
Figure 8B:
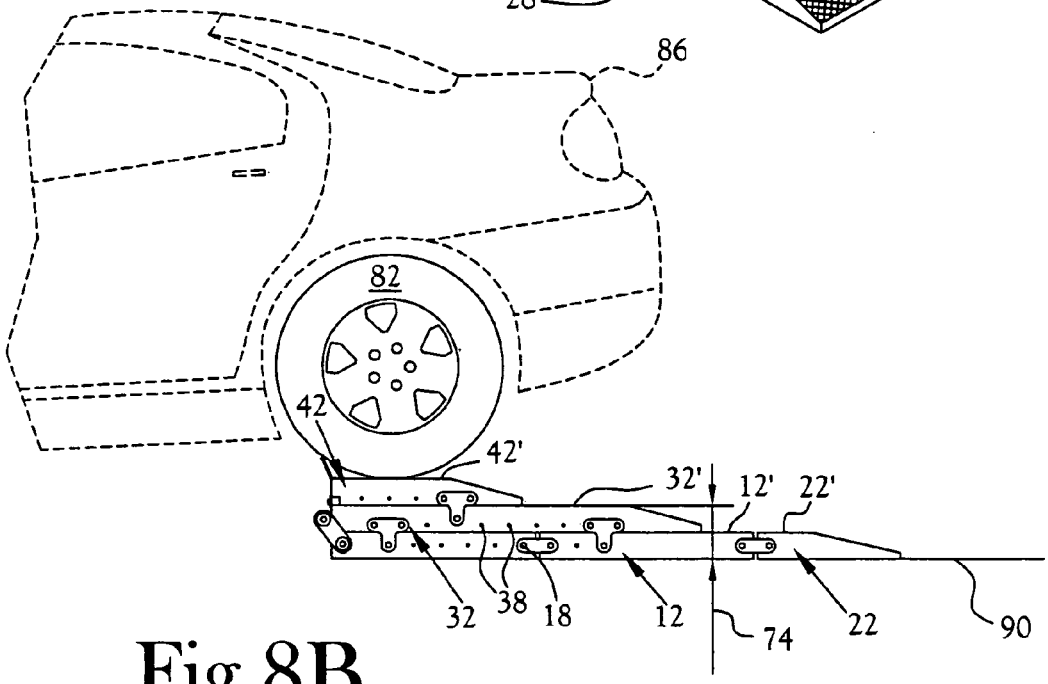
FIG. 8B is a side view of a wheel lift having a rear wheel rotated to a third support surface after assembly of the wheel lift in front of the rear wheel.
Figure 9:
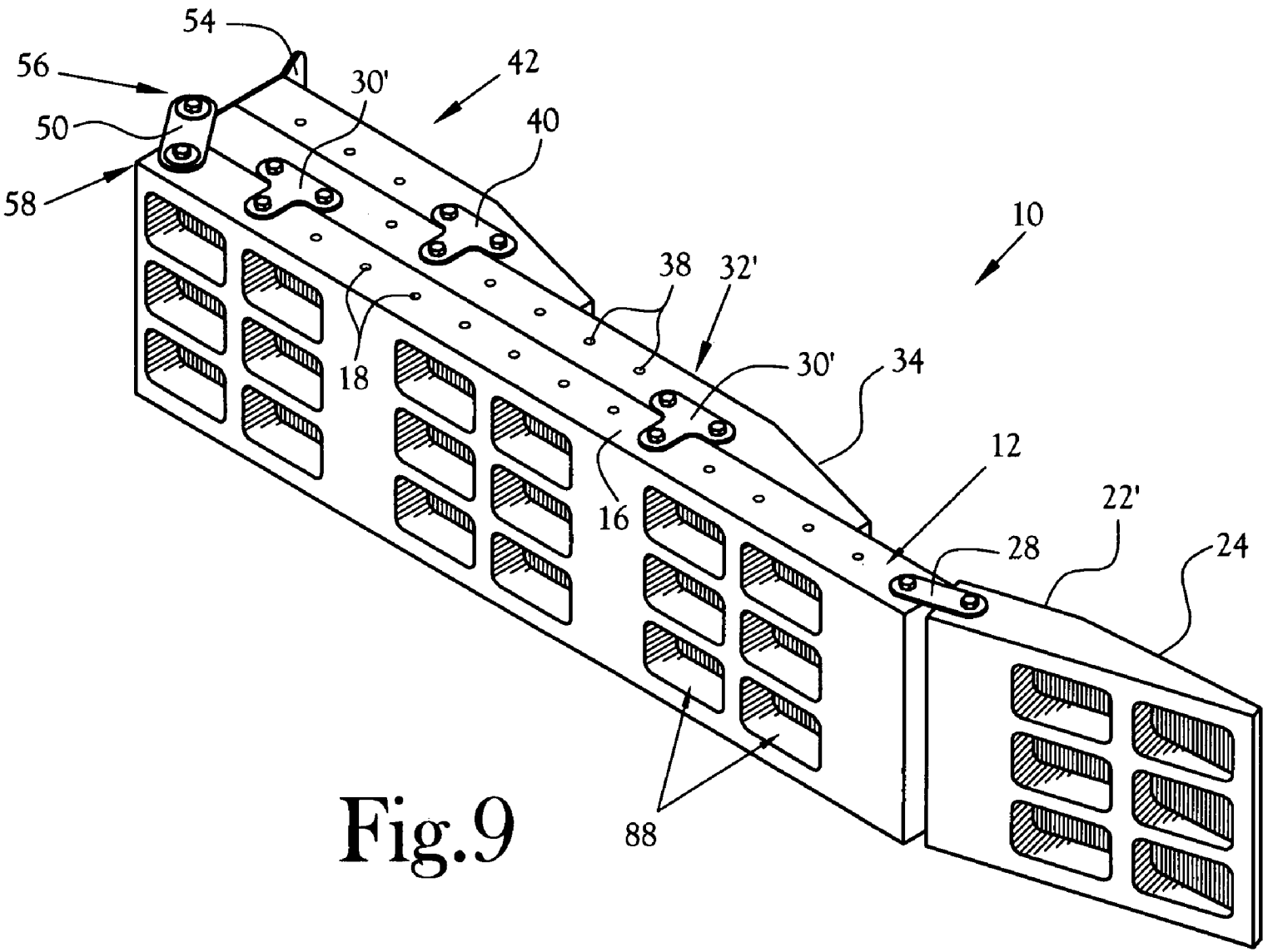
FIG. 9 is a perspective view of the underside of the wheel lift of FIG. 1.

In order to facilitate stacking by laterally positioning second lift unit 32 on the rear surface of base support surface 12' as illustrated in FIG. 2, or on the alternative embodiment of two part base lift unit 12" " as illustrated in FIG. 7, a safety stop having a raised ridge 16''' of about one-half inch extends upwards from the rear end of the base unit surface 12' or 12'''. The raised ridge 16''' is slidingly inserted into a corresponding sized slot 32'' in the lower rear edge of second lift unit 32. A similarly shaped safety stop having a raised ridge 36''' of about one-half inch extends upwards from the rear end of the second lift unit 32. A corresponding sized slot is also provided in the lower rear edge of a third lift unit 42, as described below. To facilitate stacking of one base support surface 12' as illustrated in FIG. 2, or an alternative embodiment of two part base lift unit 12'''' as illustrated in FIG. 7, on like-configured base lift units (not shown), the lower rear edge of either base lift unit 12', 12'''' can include a slot 16'' therein (see FIG. 7).

A third lift unit 42 is laterally positionable to align and stack on a rearward portion of the second lift support surface 32' to provide a third lift height of about nine inches to further elevate a front wheel 80 or rear wheel 82 above the ground surface 90. The third lift unit 42 includes a width 42'' of between about ten inches to about fourteen inches, and a third length 42''' of between about twelve inches to about twenty-four inches. The third lift unit 42 includes a depth of between about three inches to about four inches in height, and is laterally positioned to stack on the rearward portion of the second support surface 32' by manipulation over either the left side 36 or over the right side 36' of the second lift unit 32 to stack on the rearward portion of the second support surface 32' regardless of whether a wheel is positioned on the first support surface 22', the base support surface 12', or the wheel is rotated on the second support surface 32'. A third ramp surface 44 is angled at preferably about twelve degrees to about twenty degrees for gradual traversal of the vehicle wheel from the second support surface 32' to the third support surface 42'. The depth of the third lift unit 42 is between about three inches to about four inches, therefore the overall height of the third support surface 42' of the third lift unit 42, stacked on the second support unit 32, which is stacked on the base lift unit 12, is between about nine inches to about ten inches above the ground surface 90. To retain third lift unit 42 on second support surface 32', a slot is provided in the lower rear edge of the third lift unit 42, in which raised ridge 36''' is received therein (see FIG. 7).

During use, the third lift unit 42 is laterally positioned on and temporarily secured to the second support surface 32' utilizing at least one releasable side bracket 40 connected to either the left or right side surfaces 36, 36' of the second lift unit 32. The releasable side brackets 30, 40 and associated connecting bolts 30', 30'', 40', 40'' are oriented along either the left sides 16, 26 36, 46 or the right sides 16', 26', 36', 46' of the wheel lift 10, in order to provide a "left-hand" wheel lift 10, or a "right-hand" wheel lift 10' (see FIG. 7). Upon assembly by connection of at least one pivotable connector 28 and at least two side brackets 30, 40 on one side such as the left side of the modular wheel lift 10, the primary ramp unit 22 can be positioned in front of respective one or both left wheels, or in back of respective one or both right wheels. Rotation of the wheel onto the ramp unit 22 provides lifting of at least three inches, while retaining the orientation of the connectors and side brackets outboard of the lifted wheel to allow rapid manipulation to add or remove the second lift unit 32, and/or the third lift unit 42 by an operator without requiring the operator to reach behind or under portions of each elevated wheel, thereby providing an additional safety feature during use of the modular wheel lift 10. A typical assembly of a "right-hand" wheel lift 10' is illustrated in FIG. 7.

An extension lift unit 62 provides a fourth lift height of about twelve inches for a wheel 80 or 82 moved from the third support surface 42' and on the extension lift unit 62. A generally rectangular unit is laterally positioned in alignment with rear portions of the stacked base lift unit 12, second lift unit 32, and third lift unit 42 (see FIGS. 4 and 7). The extension lift unit 62 includes a ramp surface 64 angled between at about twelve degrees to about twenty degrees to an extension support surface 62' to provide a fourth extension lift height of about twelve inches to about fourteen inches above the ground surface 90. The extension lift unit 62 includes a width 62'' of between about ten inches to about fourteen inches, and an extension length 62''' of between about twenty inches to about twenty-six inches. The extension lift unit 62 is releasably connected to the rear side portions of base lift unit 12, or to alternative base lift unit 12'''', by one or two brackets 28, 28' being attached therebetween. An "anti-kickout" improvement includes a back surface 66 of the extension lift unit 62 having a lower base portion 68 angled outwards for about two inches to about three inches at the base of the back surface 66. The lower base portion 68 provides a more stable base surface providing a broad base footprint to distribute the weight of the vehicle over a large area of the ground surface 90 and to minimize any "kicking backwards" of the modular wheel lift 10, 10' during movement of a wheel up each respective ramp surface 24, 34, 44, 64. An added safety feature includes abrasive mats 70, 70', 70'', 70''' of metal or plastic having convoluted surfaces which are removably secured by bonding or by connectors in countersink positions on each respective ramp surface 24, 34, 44, 64 to improve wheel traction up or down each ramp.

Figures 3A, 3B, 4:
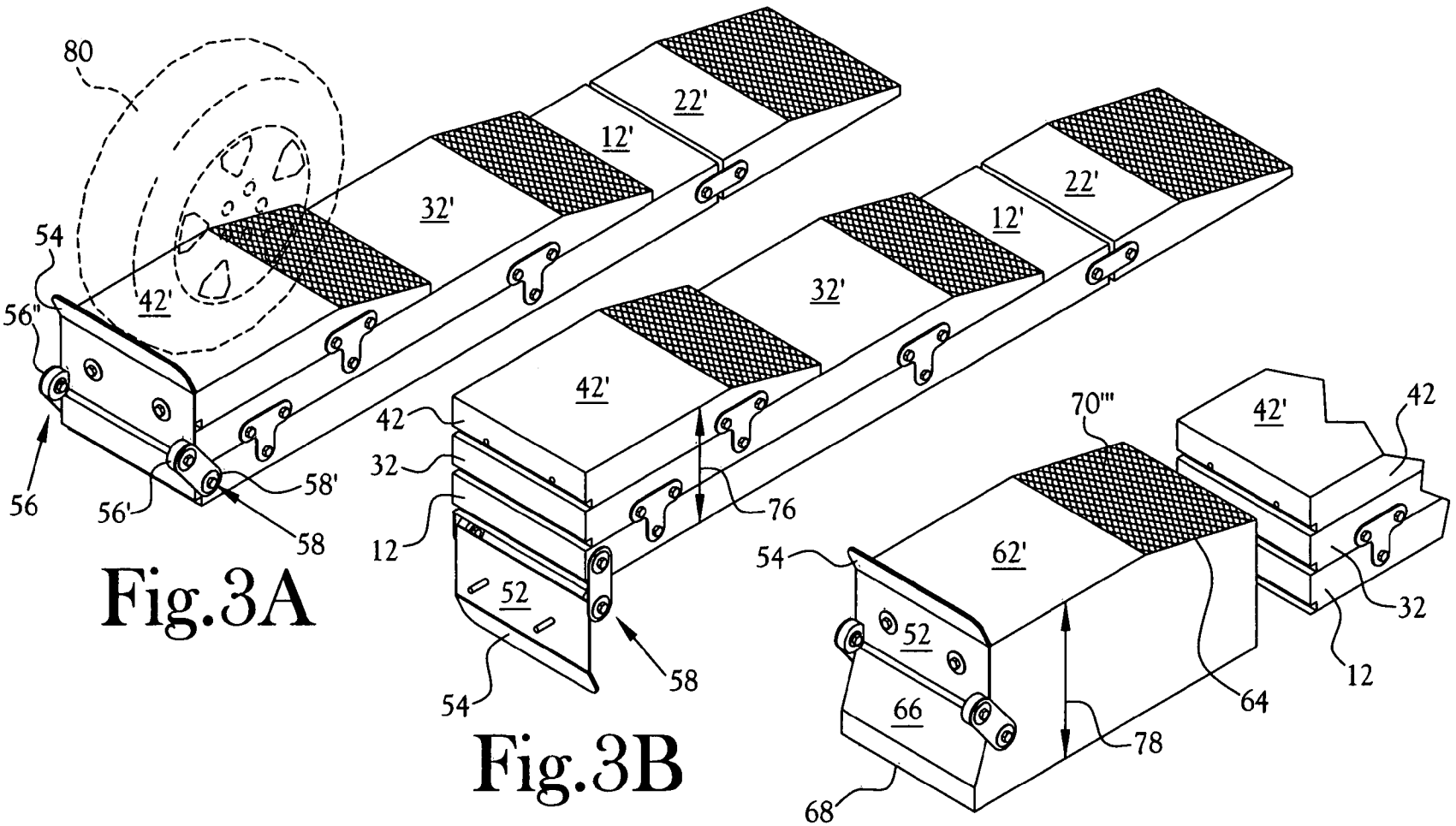
FIG. 3A is a rear perspective view of the wheel lift of FIG. 1, illustrating a raised rear pivot bracket.
FIG. 3B is a rear perspective view of the wheel lift of FIG. 3A, illustrating a lowered rear pivot bracket.
FIG. 4 is a rear perspective of a fourth lift unit having a raised rear pivot bracket attached thereto.
Figure 5:
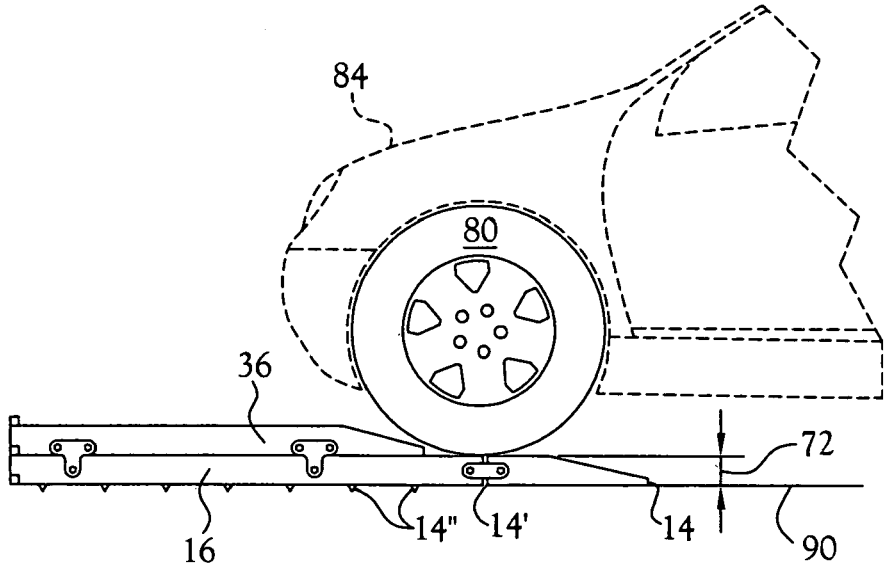
FIG. 5 is a side view of the wheel lift of FIG. 1, illustrating a front wheel of a vehicle positioned on a first support surface.
Figure 6:
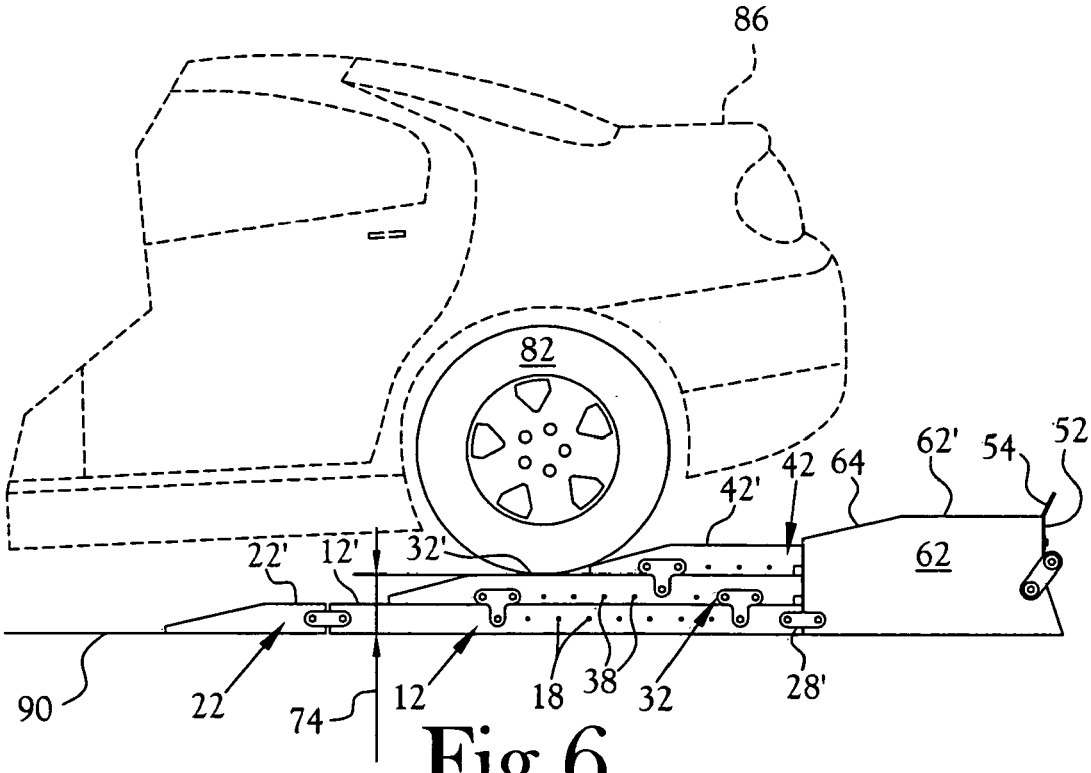
FIG. 6 is a side view of the wheel lift of FIG. 1, illustrating a rear wheel of a vehicle positioned on a second support surface aligned with a third and fourth support surface positioned to readily receive the rear wheel thereon.

A pivotable stop bracket 52 is removably attachable to vertically align against a back surface 66 of the extension lift unit 62 (see FIG. 4). Alternatively, when the extension lift unit 62 is not utilized, the pivotable stop bracket 52 is removably attachable to the rearward portions of the stacked base, second and third lift units 12, 32, 42 (see FIGS. 3A and 3B). The stop bracket 52 includes a flanged plate 54 having a curved upper edge 54' which projects above the uppermost support surface 62' or 42', when the flanged plate 54 is positioned in a substantially vertical orientation. A means for pivoting includes an upper pivot 56 mechanism having two connector bars 50, 50', bushings 56', 56''' and connectors 56''' which provide pivoting motion at an upper end of connector bars 50, 50' when positioned and attached adjacent to rear sides of the extension lift unit 62 or the uppermost third lift unit 42. The means for pivoting further includes a lower pivot 58 mechanism attached to the lower ends of two connector bars 50, 50', with bushings or washers 58, 58'' and connectors 58''' which provide pivoting motion at an lower end of connector bars 50, 50' when positioned and attached adjacent to rear lower sides of the extension lift unit 62, or attached to rear lower left side 16 and right side 16' of the base lift unit 12. The upper edge of the flanged plate 54 provides a stop mechanism against which an elevated wheel 80, 82 rests when the wheel is positioned in a third lift position 76 on third support surface 42', or when the wheel is positioned in a fourth lift position 78 on fourth support surface 62'.

A method for assembly and operation of a modular wheel lift system includes a unique assembly process utilizing a portable modular wheel lift 10 for elevation to a variety of heights of any combination of one or more front wheels 80 and/or rear wheels 82 of a vehicle having body portions extended to a minimal height above the ground for either front, side, and/or rear body portions of the vehicle. The method for assembly and operation is illustrated in FIG. 7 and includes a step of providing an elongated base lift unit 12 having a broad base width 12" of up to about fourteen inches in width and a first lift height of about three to about four inches, and providing a primary ramp unit 22 having approximately the same base width and having a ramp surface gradually extending to the first lift height of about three to about four inches. A step of joining includes connecting a pivoting means to extend between a non-sloped end of the primary ramp unit 22 and a forward end of base lift unit 12. The pivoting means includes a pivoting joint releasably attached to respective aligned side surfaces of a leading end of the primary ramp unit 22 and a trailing end of the base lift unit 12. The steps of providing and joining provide a base lift unit 12 having a first lift height 72 and aligned with a primary ramp unit 22 that is adjustable in vertical angle relative to the base lift unit to allow operation of the following steps for elevating a vehicle wheel to operate on uneven ground surfaces. Prior ramp devices have typically been limited in use to level paved surfaces.

A step of aligning provides for the joined base lift unit 12 and primary ramp unit 22 to be aligned in front of or behind a front wheel 80 (see FIGS. 5, 7 and 8A), or aligned in front of or behind with a rear wheel 82 (see FIGS. 6 and 8B), for rotational movement of a wheel up the ramp unit 22 and on the base support surface 12' of the base lift unit 12. The front or rear wheel is typically maintained on the base support surface 12' at the first lift height 72 until vehicle repairs are complete, or until additional steps of stacking and securing are completed to allow further wheel rotational movement up on and down from an uppermost lift height 76 or 78, without disruption of the vehicle body portions proximal of the wheel during wheel rotational movement on and off of the modular wheel lift 10. It is emphasized that the repetitive steps of aligning, moving and lifting the vehicle, followed by steps of stacking and securing additional lift units 32, 42 on and above the base support surface 12', are accomplished after aligning the joined base lift unit 12 and primary ramp unit 22 behind a front wheel 80 (see FIG. 8A), or after aligning in front of a rear wheel 82 (see FIG. 8B), despite a limited height clearance provided by low-profile vehicles. The low height of about three inches to about four inches of the base lift unit 12 allows ease of alignment under the middle side portions of a vehicle, regardless of a lowered height of one or more side moldings added behind a front wheel 80 and/or in front of a rear wheel 82 of a low-profile vehicle, without disruption of the side moldings. Prior jacking devices are not positionable behind the front wheels or in front of rear wheels of a low-profile vehicle, if the jack height is greater than about four inches or five inches.

Repetitive steps of stacking and securing provide for attaining second and third lift heights by laterally positioning a second lift unit 32 over a left side or right side of the base lift unit 12 for stacking on the rearward 14' portion of the base support surface 12'. The step of stacking includes securing the second lift unit 32 with side brackets 30 and connectors 30" which are releasably attached to a left side 16 or a right side 16' of the base lift unit 12, thereby providing a "left-handed" modular lift unit 10 or a "right-handed modular lift unit 10'. Repetitive steps of stacking the second lift unit 32 and a third lift unit 42 provide for attaining a third lift height by laterally positioning a third lift unit 42 on the second support surface 32', and securing the third lift unit 42 on second support surface 32 with one or more side brackets 40 and connectors 30". The repetitive steps of stacking and securing are accomplished by lateral access to each uppermost lift unit support surface while a vehicle wheel is positioned on the first lift surface 12', 22' (see FIG. 7). Upon completion of the repetitive steps of stacking and securing, a step of sequentially rotating the vehicle wheel provides for traversal of the wheel across an upper support surface 32', 42' of each stacked additional lift unit to elevate the wheel to incrementally increased heights up to the uppermost lift height without disruption of the vehicle body portions.

A step of positioning and attaching a pivotable stop member 52 is further provided to retain the vehicle wheel on the uppermost support surface. The step of positioning and attaching the pivotable stop member 52 includes attaching to non-sloped ends of the stacked additional lift units 12, 32, 42, or to the rear end of the extension lift member 62, in order to arrest a vehicle wheel at the uppermost lift height on the uppermost additional lift unit. The pivotable stop member 52 includes a flanged portion 54 extending above the uppermost support surface 42' or 62'. The pivotable stop member 52 is connected respective to the plurality of non-sloped ends of the stacked lift units 12, 32, 42. The pivotable stop member 52 is readily manipulated by an operator to an upright position against the non-sloped ends of the stacked modular lift units to extend a flanged upper portion 54 above the uppermost support surface, thereby arresting the movement of a vehicle wheel 80, 82 to be retained on the uppermost support surface of the stacked lift units 12, 32, 42. The method for assembly and operation provides for elevating and retention of a front wheel 80 or a rear wheel 82 on to the uppermost support surface provided by the assembled lift units 12, 32, 42 and the extension lift member 52 without disruption of body portions extending from a vehicle front end 84 or rear end 86.

One skilled in the art will realize that the method of assembly and operation of the modular wheel lift 10 is readily applied for lifting either or both front wheels, for lifting either or both rear wheels, and for lifting both side wheels by utilizing at least two modular wheel lifts without departing from the spirit and scope of the present invention. An additional method for assembly and operation includes providing two pair of modular wheel lifts having a first and a second overall height for each pair, in order to elevate to a height the front wheels to a height different than the rear wheels, or to elevate the right side wheels to a different height than the left side wheels due to an uneven ground surface or to facilitate drainage of lubricants from the vehicle engine or transmission.

While the present invention has been illustrated by description of several embodiments and methods for utilization and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A modular wheel lift for elevating at least one wheel of a vehicle having body portions extended to a height proximal to the ground, comprising:

a base lift unit including forward and rearward portions of a base support surface having a base length greater than a base width and having a base surface height less than the height above the ground of the vehicle body portions;

a primary ramp unit hingedly attached at a non-sloped end to said base lift unit forward portion, said primary ramp unit includes a first ramp surface angled for gradual traversal by a vehicle wheel, said primary ramp unit further includes a first support surface extended rearwardly from said first ramp surface at about said base surface height;

a second lift unit having a second length less than said base length and a second width comparable to said base width, said second lift unit is stackable by laterally positioning on said rearward portion of said base support surface, said second lift unit having a second ramp surface angled to a second support surface for traversal by the vehicle wheel to said second support surface disposed at a second height greater than said base surface height;

a plurality of side brackets having elongated configurations of sufficient length to releasably attach opposed ends between respective right and left side surfaces of said second lift unit stacked on said base lift unit; and a third lift unit having a third length less than said second length of said second lift unit and having a third width comparable to said base width, said third unit is stackable by laterally positioning onto said rearward portion of said second support surface, said third lift unit having a third ramp surface angled for traversal by the vehicle wheel from said second support surface onto a third support surface horizontally disposed at a third height greater than said second support surface height;

whereby the vehicle wheel is moved to traverse said first ramp surface and said first support surface of said primary ramp unit to be positioned on said base support surface without disruption of the vehicle body portions;

whereby the vehicle wheel is further moved to traverse said second ramp surface to be positioned on said second support surface for elevation to said second height above the ground without disruption of the vehicle body portions.

2. The apparatus of claim 1 further including a fourth lift unit having a fourth length approximately equal to said third length of said third lift unit and having a fourth width comparable to said base width, said fourth lift unit is disposed by laterally positioning against respective rearward portions of each of said base lift unit, said second lift unit and said third lift unit, said fourth lift unit having a fourth ramp surface angled for traversal by the vehicle wheel from said third support surface onto a fourth support surface horizontally disposed at a fourth height greater than said third support surface height.

3. The apparatus of claim 2 further including said base lift unit, second lift unit, and third lift unit having right and left sides in which a plurality of aligned spaced-apart connector holes are disposed.

4. The apparatus of claim 2 further including a rear stop member disposed in pivoting connection to said rearward end of either of said third lift unit or said fourth lift unit when aligned with said third lift unit, said rear stop member is detachable from said rearward end to provide pivotable movement from an upright position to a lowered position extending behind either of said rearward ends of third lift unit or fourth lift unit.

5. The apparatus of claim 2 wherein each ramp surface of said primary ramp unit, second lift unit, third lift unit and fourth lift unit includes a ramp surface angle of between about 12 degrees to about 20 degrees from horizontal.

6. The apparatus of claim 1 further including a fourth lift unit having a fourth length approximately equal to said third length of said third lift unit and having a fourth width comparable to said base width, said fourth lift unit is disposed by laterally positioning against respective rearward portions of each of said base lift unit, said second lift unit and said third lift unit, said fourth lift unit having a fourth ramp surface angled for traversal by the vehicle wheel from said third support surface onto a fourth support surface horizontally disposed at a fourth height greater than said third support surface height.

7. A method for elevating at least one wheel of a vehicle having body portions at a height proximal to the ground, comprising the steps of:

providing an elongated base lift unit and a primary ramp unit having substantially equal widths and each having a first lift height equal or less than the vehicle body portion height proximal to the ground;

joining said primary ramp unit in alignment with said base lift unit, said step of joining including connecting means for pivoting extended between one end of said primary ramp unit and a non-sloped end of said primary ramp unit;

aligning said base lift unit and said joined primary ramp unit in alignment with the vehicle wheel;

moving the wheel in rotational movement to traverse respectively said ramp unit and said lift unit, whereby the wheel is elevated to said first lift height on said base lift unit;

stacking additional lift units on said base lift unit by laterally access thereon, each additional lift unit having a progressively lesser length, having an equal width, and having an equal incremental lift height whereby an uppermost lift height is provided upon completion of said stacking step;

securing each additional lift unit to the next lower lift unit utilizing a plurality of side brackets releasably secured between respective side surfaces of said base lift unit and each additional lift unit stacked thereon; and sequentially rotating the wheel to traverse each stacked additional lift unit thereby elevating the wheel to incrementally increased heights up to an uppermost lift height without disruption of the vehicle body portions;

whereby the step of sequentially rotating the wheel is repeated with reversed rotational movement of the wheel for reducing the wheel height to ground level without disruption of the vehicle body portions.

8. The method of claim 7 further comprising a step of attaching an extension lift member to a rear portion of said stacked additional lift units, said step of attaching said extension lift member providing an additional lift height for sequentially rotating the wheel on to an upper support surface of said extension lift member.

9. The method of claim 7, further comprising a step of attaching a pivotable stop member to a non-sloped end of said stacked additional lift units, said step of attaching includes manipulating said pivotable stop member in a vertical orientation with said pivotable stop member having an upper portion extended above said uppermost lift height whereby movement of the wheel is arrested at said uppermost lift height on the uppermost additional lift unit.

10. The method of claim 8, further comprising a step of attaching a pivotable stop member to a non-sloped rear end of said extension lift member said step of attaching includes manipulating said pivotable stop member in a vertical orientation with said pivotable stop member having an upper portion extended above said uppermost lift height whereby movement of the wheel is arrested at said uppermost lift height on said upper support surface of said extension lift member.

11. A system of assembly of a modular wheel lift for elevating at least one wheel of a vehicle having body portions extended to a height proximal to the ground, comprising the steps of:

providing an elongated base lift unit and a primary ramp unit having substantially equal widths and each having a first lift height equal or less than the vehicle body portion height proximal to the ground;

joining said primary ramp unit in alignment with said base lift unit, said step of joining including connecting means for pivoting extended between one end of said primary ramp unit and a non-sloped end of said primary ramp unit;

aligning said base lift unit and said joined primary ramp unit in alignment with the vehicle wheel;

moving the wheel in rotational movement to traverse respectively said ramp unit and said lift unit, whereby the wheel is elevated to said first lift height on said base lift unit;

stacking additional lift units on said base lift unit by laterally accessing each respective additional lift unit on to said base lift unit, each additional lift unit having a length of progressively lesser length, having a width substantially equal to said base lift unit width, and having a lift height substantially equal to said base lift unit lift height, whereby an uppermost lift height is provided upon completion of said stacking step;

securing each additional lift unit to the next lower lift unit utilizing a plurality of side brackets releasably secured between respective side surfaces of said base lift unit and each additional lift unit stacked thereon;

attaching a pivotable stop member to a non-sloped end of said stacked additional lift units, said step of attaching includes manipulating said pivotable stop member in a vertical orientation with said pivotable stop member having an upper portion extended above said uppermost lift height whereby movement of the wheel is arrested at said uppermost lift height on the uppermost additional lift unit; and sequentially rotating the wheel to traverse each stacked additional lift unit thereby elevating the wheel to incrementally increased heights up to an uppermost lift height without disruption of the vehicle body portions;

whereby the step of sequentially rotating the wheel is repeated by reversed rotational movement of the wheel for reducing the wheel height to ground level without disruption of the vehicle body portions.

* * * * *